US011710916B2

(12) United States Patent
Chen et al.

(10) Patent No.: US 11,710,916 B2
(45) Date of Patent: Jul. 25, 2023

(54) SURFACE MOUNT ELECTRICAL CONNECTOR

(71) Applicant: Amphenol Corporation, Wallingford, CT (US)

(72) Inventors: Jamison Chen, Xiangyang (CN); Kelvin Kun Tang, Shen Zhen (CN); Hao Zhou, Kunshan (CN); Adrian Green, Newcastle (CA)

(73) Assignee: AMPHENOL CORPORATION, Wallingford, CT (US)

( * ) Notice: Subject to any disclaimer, the term of this patent is extended or adjusted under 35 U.S.C. 154(b) by 210 days.

(21) Appl. No.: 17/273,979

(22) PCT Filed: Feb. 10, 2021

(86) PCT No.: PCT/CN2021/076474
§ 371 (c)(1),
(2) Date: Mar. 5, 2021

(87) PCT Pub. No.: WO2022/170550
PCT Pub. Date: Aug. 18, 2022

(65) Prior Publication Data

US 2022/0360003 A1 Nov. 10, 2022

(51) Int. Cl.
*H01R 12/72* (2011.01)
*H01R 12/55* (2011.01)
(Continued)

(52) U.S. Cl.
CPC ..... *H01R 12/727* (2013.01); *H01R 12/55* (2013.01); *H01R 13/6658* (2013.01); *H01R 24/64* (2013.01); *H01R 2107/00* (2013.01)

(58) Field of Classification Search
CPC ..... H01R 12/727; H01R 12/15; H01R 13/6658; H01R 24/64
(Continued)

(56) References Cited

U.S. PATENT DOCUMENTS 8,197,264 B1 * 6/2012 Eakins ..... H01R 12/57 439/83
9,397,450 B1 * 7/2016 Feng ..... H01R 13/659
(Continued)

FOREIGN PATENT DOCUMENTS

CN 102292375 A 12/2011
CN 102655280 A 9/2012
(Continued)

OTHER PUBLICATIONS

International Search Report and Written Opinion from PCT/CN2021/076474 dated Oct. 26, 2021.

*Primary Examiner* — Alexander Gilman
(74) *Attorney, Agent, or Firm* — Cantor Colburn LLP

(57) ABSTRACT

A surface mount electrical connector and methods of making and using a surface mount electrical connector. The connector includes a housing and a contact subassembly received in the housing. The contact subassembly includes interface contacts, board termination contacts, and an internal circuit board. The interface contacts and the board termination contacts are mounted to the internal circuit board to electrically connect the interface contacts and the board termination contacts through the internal circuit board. Each of surface mount tail ends of the board termination contacts has a bent portion that defines a mounting surface configured to be surface mounted to a mounting face of a main circuit board, to establish an electrical connection between the board termination contacts and the main circuit board.

20 Claims, 3 Drawing Sheets

(51) Int. Cl.
*H01R 13/66* (2006.01)
*H01R 24/64* (2011.01)
*H01R 107/00* (2006.01)

(58) Field of Classification Search
USPC ..... 439/676
See application file for complete search history.

(56) References Cited

U.S. PATENT DOCUMENTS

| | | | | |
|---|---|---|---|---|
| 10,559,915 | B1 * | 2/2020 | Pahulje | H01R 13/5216 |
| 2011/0097933 | A1 * | 4/2011 | Sommers | H05K 3/00 29/843 |
| 2020/0373689 | A1 * | 11/2020 | Cartier | H01R 9/24 |

FOREIGN PATENT DOCUMENTS

| | | | |
|---|---|---|---|
| CN | 103972678 | A | 8/2014 |
| CN | 106252923 | A | 12/2016 |
| CN | 110707453 | A | 1/2020 |
| CN | 111628353 | A | 9/2020 |

* cited by examiner

SURFACE MOUNT ELECTRICAL CONNECTOR

CROSS-REFERENCE TO RELATED APPLICATION

This is a national stage of PCT/CN2021/076474, filed Feb. 10, 2021, the disclosure of which is incorporated by reference in its entirety herein.

TECHNICAL FIELD

This disclosure relates generally to high speed electrical connectors used for networking, telecom, server and computer, data storage and HDD, consumer electronics, and entertainment, professional audio and industrial and military/aerospace applications.

BACKGROUND

Typical applications of high speed modular jacks utilize through hole PCB terminations which require a wave solder process to attach them to the board. Wave soldering is a bulk soldering process used in the manufacture of printed circuit boards. The circuit board is passed over a pan of molten solder in which a pump produces an upwelling of solder that looks like a standing wave. Wave soldering, however, requires extra processing steps in manufacturing.

SUMMARY

The present disclosure relates to a surface mount electrical connector that comprises a housing defining an inner receiving area, the housing has opposite first and second ends, and the first end has an interface opening for receiving a mating connector. A contact subassembly is received in the inner receiving area of the housing. The contact subassembly includes a plurality of interface contacts. Each of the plurality of interface contacts has a free end and an engagement end, and the free ends are configured to mate with corresponding contacts of the mating connector. The contact subassembly also has a plurality of board termination contacts, each of the plurality of board termination contacts has an engagement end and a surface mount tail end. And an internal circuit board has a supporting surface, wherein the plurality of interface contacts and the plurality of board termination contacts are mounted to the supporting surface of the internal circuit board with the engagement ends of the plurality of interface contacts and the plurality of board termination contacts being coupled to the internal circuit board, thereby electrically connecting the plurality of interface contacts and the plurality of board termination contacts through the internal circuit board. Each of the surface mount tail ends of the plurality of board termination contacts has a bent portion that defines a mounting surface configured to be surface mounted to a mounting face of a main circuit board, to establish an electrical connection between the plurality of board termination contacts and the main circuit board.

In certain examples, the mounting surface of each of the surface mount tails ends of the plurality of termination contacts is configured to abut the mounting face of the main circuit board; each of the mounting surfaces is substantially flat and the mounting face of the main circuit board is substantially flat; the mounting surfaces of the plurality of board termination contacts are soldered to the mounting face of the main circuit board; the internal circuit board has capacitive compensation circuits; and/or the bent portions of the plurality of board termination contacts generally form a right angle.

In other examples, the plurality of interface contacts are supported by a front dielectric insert and the plurality of board termination contacts are supported by a rear dielectric insert separate from the front dielectric insert; each of the front and rear dielectric inserts has a locating post configured for insertion into a corresponding hole of the internal circuit board; the engagement ends of the plurality of interface contacts and board termination contacts are soldered to the internal circuit board; and/or the connector further comprises a shield covering the housing, and the shield is electrically connected to the main circuit board via a tab extending outwardly from the shield.

The present disclose may also relate to a high speed electrical connector that comprises a housing defining an inner receiving area, the housing has opposite first and second ends, and the first end has an interface opening for receiving a mating connector. A contact subassembly is received in the inner receiving area of the housing. The contact subassembly includes a plurality of interface contacts, each of the plurality of interface contacts has a free end and an engagement end, and the free ends are configured to mate with corresponding contacts of the mating connector. The contact subassembly also has a plurality of board termination contacts, each of the plurality of board termination contacts has an engagement end and a surface mount tail end, and an internal circuit board that has a supporting surface, wherein the plurality of interface contacts and the plurality of board termination contacts are mounted to the supporting surface of the internal circuit board with the engagement ends of the plurality of interface contacts and the plurality of board termination contacts being coupled to the internal circuit board, thereby electrically connecting the plurality of interface contacts and the plurality of board termination contacts through the internal circuit board. The internal circuit board has capacitive compensation circuits. Each of the surface mount tail ends of the plurality of termination contacts has a bent portion that defines a mounting surface configured to be surface mounted to a mounting face of a main circuit board, to establish an electrical connection between the plurality of board termination contacts and the main circuit board.

In some embodiments, the bent portions of the plurality of board termination contacts generally form a right angle such that the mounting surfaces are positioned to be surface mounted to the mounting face of the main circuit board by soldering; each mounting surface is substantially flat; and/or the engagement ends of the plurality of interface contacts and board termination contacts are soldered to the internal circuit board.

The present disclosure may also relate to a method of manufacturing a surface mounted electrical connector that comprises the steps of forming a contact subassembly by, attaching engagement ends of a plurality of interface contacts to a supporting surface of an internal circuit board leaving free ends of the plurality of interface contacts positioned for mating with a mating connector, and attaching engagement ends of a plurality of board termination contacts to the supporting surface of the internal circuit board. Bent portions of the plurality of board termination contacts of the contact subassembly are configured to be surface mounted to a mounting face of a main circuit board by reflow soldering.

In certain examples, the bent portions of the plurality of board termination contacts are configured to be soldered to the main circuit board without using a wave soldering process; the bent portions each have a substantially flat mounting surface for abutting the mounting face of the main circuit board; the internal circuit board includes capacitive compensation circuits coupled to the engagement ends of the plurality of interface contacts and the plurality of board termination contacts; the engagement ends of the plurality of interface contacts and the plurality of board termination contacts are attached to the internal circuit board by soldering; and/or the plurality of interface contacts are supported by a front dielectric insert and the plurality of board termination contacts are supported by a rear dielectric insert separate from the front dielectric insert.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE DRAWINGS

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Figure 1:
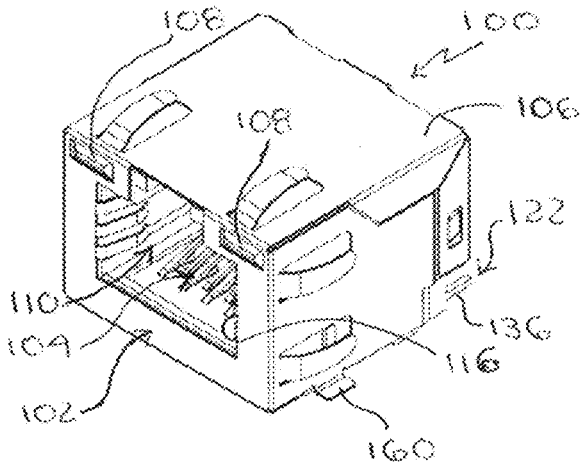
FIG. 1 is a front perspective view of an exemplary electrical connector, according to an example of the present disclosure.

The present disclosure discloses a surface mount electrical connector that comprises a housing that defines an inner receiving area. The housing has opposite first and second ends, the first end has an interface opening for receiving a mating connector. A contact subassembly is received in the inner receiving area of the housing. The contact subassembly includes a plurality of interface contacts, a plurality of board termination contacts, and an internal circuit board. Each of the interface contacts has a free end and an engagement end, and the free ends are configured to mate with corresponding contacts of the mating connector. Each of the board termination contacts has an engagement end and a surface mount tail end. The internal circuit board has a supporting surface, wherein the interface contacts and the board termination contacts are mounted to the supporting surface of the internal circuit board with the engagement ends of the interface contacts and the termination contacts being coupled to the internal circuit board, thereby electrically connecting the interface contacts and the board termination contacts through the internal circuit board. Each of the surface mount tail ends of the plurality of board termination contacts has a bent portion that defines a mounting surface configured to be surface mounted to a mounting face of a main circuit board, to establish an electrical connection between the plurality of board termination contacts and the main circuit board.

In an example, the connector is a high speed electrical connector with the internal circuit board having capacitive compensation circuits. The connector of the present disclosure meets CAT6A performance, supports Gigabit Ethernet Protocols, and 10Gig links in applications up to 100 m.

In another example, shielding may be added to the connector for increased EMI performance. LEDs may also be incorporated into the housing the connector for Link Activity and Network speed verification.

In an example, the connector of the present disclosure is a modular Jack connector incorporating an internal PCB to provide capacitive compensation in order to improve crosstalk performance for the four differential pairs carried through the connector. A rear insert provides surface mount terminations to the main PCB.

The connector of the present disclosure users achieve high speed ethernet connectivity up to 10Gigabits per second while avoiding adding a wave solder process in their board assembly process.

In an example, the surface mount tails ends of the board termination contacts are configured to be soldered to the mounting face of the main circuit board via a reflow soldering process. Reflow soldering is a process in which a solder paste is used to temporarily attach one or thousands of tiny electrical components to their contact pads on the circuit boards, after which the entire assembly is subjected to controlled heat. The solder paste reflows in a molten state, creating permanent solder joints. This process primarily has two steps. First, solder paste is accurately placed on each pad through a solder paste stencil. Second, the components are placed on pads by a pick-and-place machine. Reflow soldering can be used for attaching surface mount components to printed circuit boards (PCBs). The reflow soldering process forms solder joints by first pre-heating the components/PCB/solder paste and then melting the solder without causing damage by overheating. The advantages of reflow soldering over wave soldering, include among others, that reflow soldering (1) is less complex technique with fewer steps; (2) requires no specific controlled environment for manufacturing or temperature monitoring; and (3) does not require consideration of factors such as board orientation, pad shape, sizes, and shadowing, like wave soldering requires.

Surface mounting means the electrical components or contacts are mounted directly onto the surface of the PCB. Surface mounting does not include inserting a contact tail or pin into a through hole in the PCB.

Figure 4:
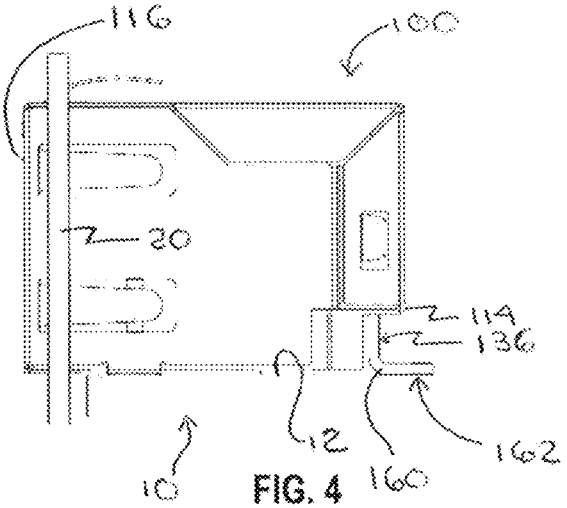
FIG. 4 is a side elevational view of the electrical connector illustrated in FIG. 1, showing the connected surface mounted to a board.
Figure 5:
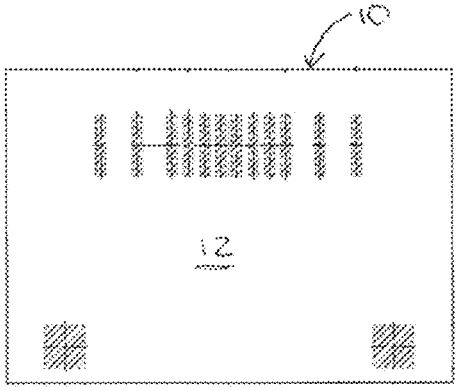
FIG. 5 is a an exemplary board layout for surface mounting the electrical connector illustrated in FIG. 4.

Referring to the figures, the electrical connector 100 of the present disclosure comprises a housing 102 and a contact subassembly 104 that is received inside of the housing 102. The electrical connector 100 is configured to be surface mounted on a main circuit board 10, as seen in FIGS. 4 and 5. A conductive shield 106 may be provided over the housing 102 for increased EMI protection. And one or more indicator LEDs 108 may be incorporated into the housing 102 for indicating connection integrity and/or speed verification, for example.

Figure 2:
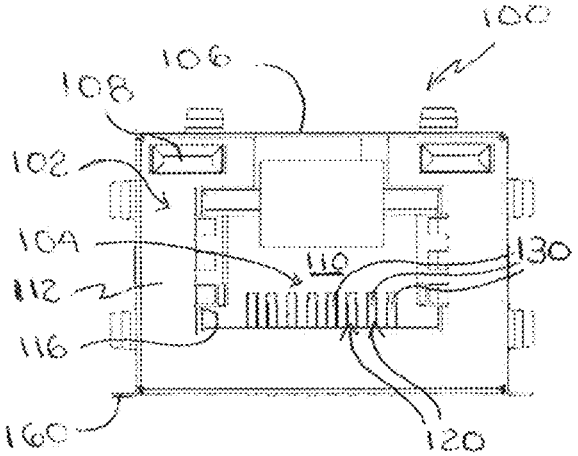
FIG. 2 is a front elevational view of the electrical connector illustrated in FIG. 1.
Figure 3:
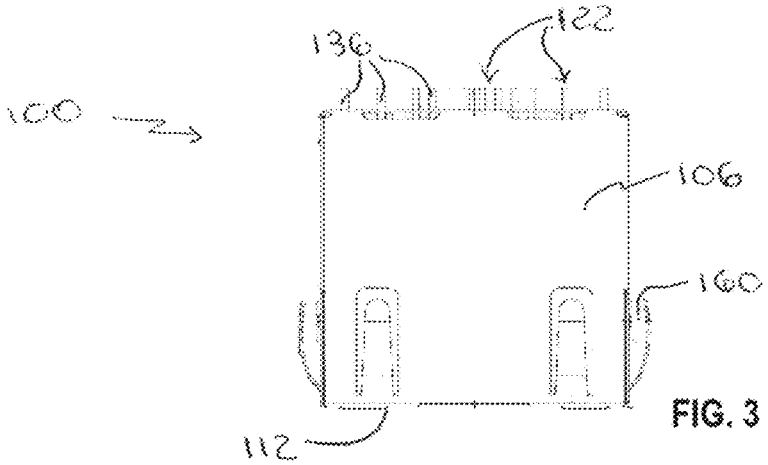
FIG. 3 is a top plan view of the electrical connector illustrated in FIG. 1.

As seen in FIGS. 1-3, the housing 102 defines an inner receiving area 110. The housing 102 has opposite first and second ends 112 and 114. The first end 112 may be the front of the connector 100 and has an interface opening 116 for receiving a mating connector. The connector 100 may be a receptacle, such as a modular RJ45 jack, for example, and the mating connector may be a corresponding plug, for example, that can be inserted into the interface opening 116 of the receptacle. The connector 100 can also be mounted in a panel 20 in addition to being mounted on the main circuit board 10, as seen in FIG. 4.

Figure 6:
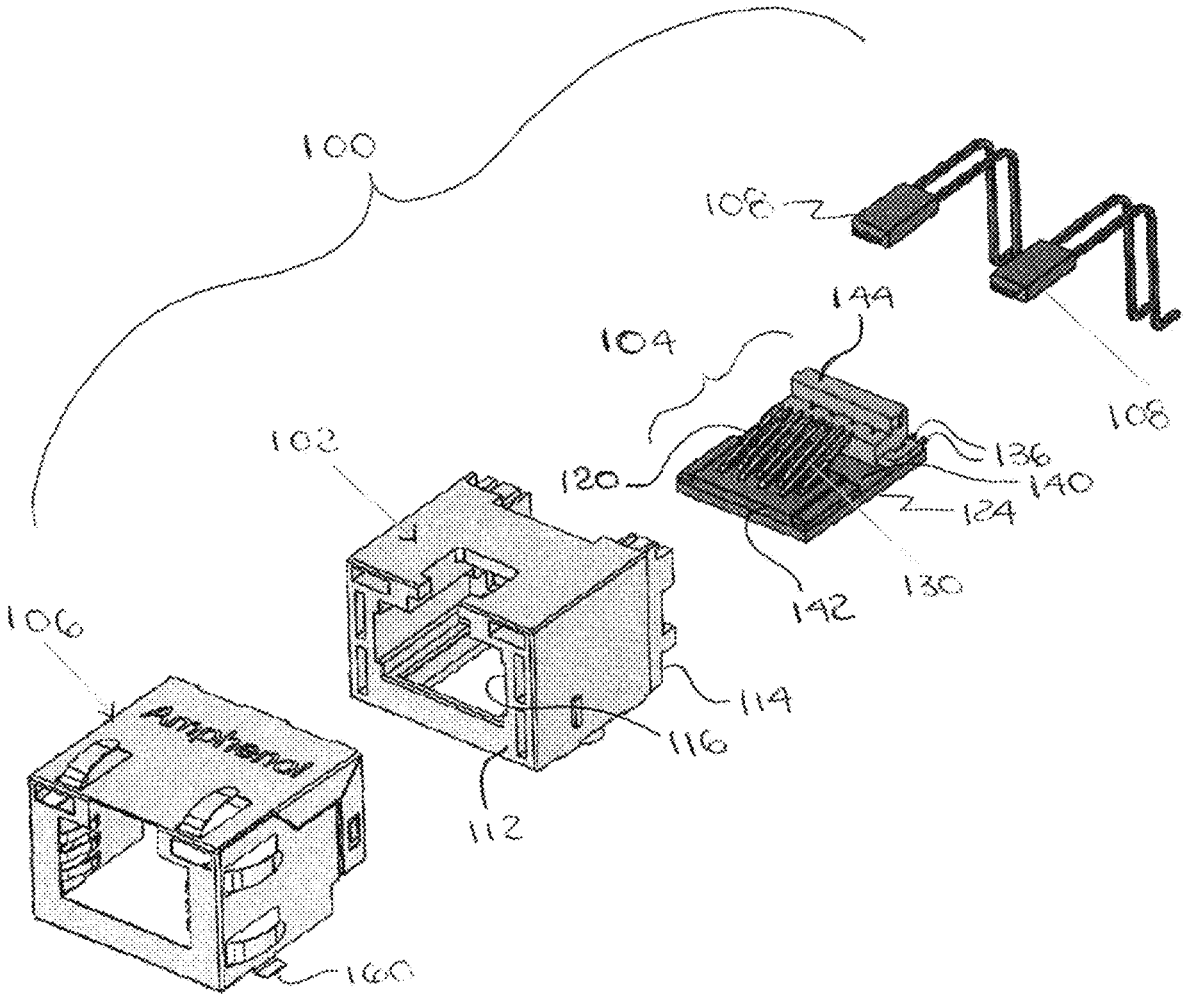
FIG. 6 is an exploded perspective view of the electrical connector illustrated in FIG. 1.
Figure 7:
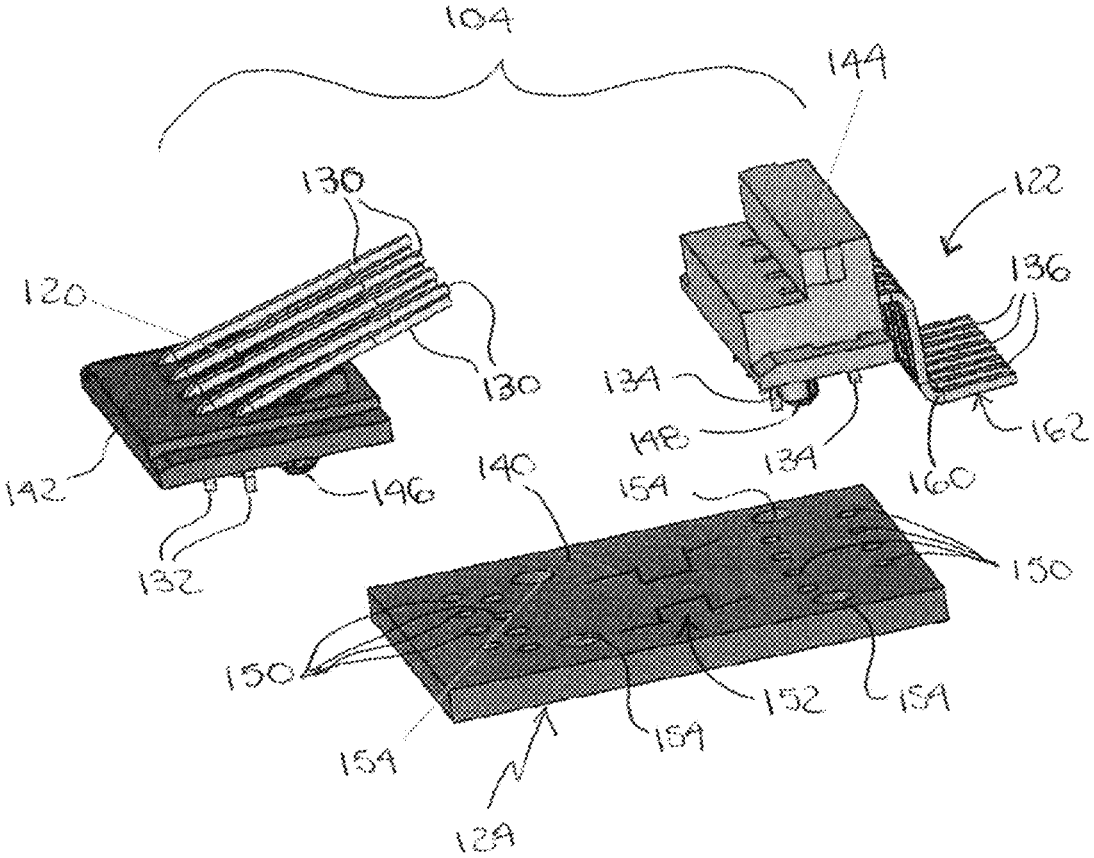
FIG. 7 is an exploded perspective view of a PCB subassembly of the electrical connector illustrated in FIG. 6.

The contact subassembly 104 is received in the inner receiving area 110 of the housing 102. The contact subassembly 104 includes a plurality of interface contacts 120, a plurality of board termination contacts 122, and an internal circuit board 124, as best seen in FIGS. 6 and 7. Each of the interface contacts 120 has a free end 130 and an engagement end 132. The free ends 130 are positioned in the housing 102 near the interface opening 116, as seen in FIG. 1, and are configured for mating with corresponding contacts of the mating connector. The engagement ends 132 of the interface contacts 120 are positioned for and configured to engage the internal circuit board 124. Likewise, each of the board termination contacts 122 has an engagement end 134 for engaging the internal circuit board 124. Each board termination contact 122 also has a surface mount tail ends 136 opposite the engagement ends 134. The surface mount tail ends 136 are configured for surface mounting of the termination contacts 122 to the main circuit board 10.

The interface contacts 120 are supported in a front dielectric insert 142 and the board termination contacts 122 are supported in a rear dielectric insert 144. The front and rear dielectric inserts 142 and 144 are both designed to mount to the internal circuit board 124, as seen in FIGS. 6 and 7. The front dielectric insert 142 has a shape configured to support the interface contacts 120 such that the free ends thereof 130 are appropriately arranged, spaced, and position for mating with the corresponding contacts of the mating connector. The front dielectric insert 142 is also shaped such that the engagement ends 132 of the interface contacts 120 are positioned to attach to the internal circuit board 124. In an example, the front dielectric insert 142 may have a generally flat and rectangular shape.

The rear dielectric insert 144 has a shape configured to support the board termination contacts 122 such that the engagement ends 134 thereof are positioned for attachment to the internal circuit board 124. The rear dielectric insert 144 also has a shape configured to support the surface mount tail ends 136 of the interface contacts 120 such that the surface mount tail ends 136 are appropriately arranged, spaced, and positioned for surface mounting on the mating face 12 of the main circuit board 10. In an example, the rear dielectric insert 144 may have a generally box and rectangular shape.

The internal circuit board 124 has a supporting surface 140 on which the front dielectric insert 142 with the interface contacts 120 and the rear dielectric insert 144 with the board termination contacts 122 are mounted and attached, as seen in FIG. 6. The front insert 142 with the contacts 120 is attached separately and spaced from the rear insert 144 with the contacts 122. When mounting the contacts 120 and 122 to the supporting surface 140, the engagements ends 132 and 134 of the contacts 120 and 122 are attached the internal circuit board, such as by soldering. In one example, the engagement ends 132 and 134 may be pins that are inserted into corresponding plated openings 150 in the internal circuit board 124, as seen in FIG. 7. The coupling of the engagement ends 132 and 134 results in an electrical connection or continuity between the interface contacts 120 and the board termination contacts 122 through the internal circuit board 124. Also, each of the front and rear dielectric inserts 142 and 144 has one or more locating post 146 and 148, respectively, for insertion into corresponding locating holes 154 in the internal circuit board 124.

The supporting surface 140 of the internal circuit board 124 may include capacitive compensation circuits 152 for signal pairs that electrically engage the interface and termination contacts 122 and 124. The capacitive compensation circuitry is used to shift the phase of the differential contact pairs so that they are less prone to crosstalk between the adjacent contact pairs. In one example, the capacitive compensation circuits 152 are designed to achieve CAT6A performance of the connector 100.

As seen in FIGS. 4 and 7, each of the surface mount tail ends 136 of the board termination contacts 122 has a bent portion 160 that defines a mounting surface 162 underneath configured to be surface mounted to the mounting face 12 of the main circuit board 10 (and the circuits or circuit pads of the board 10), to establish an electrical and mechanical connection between the board termination contacts 122 and the main circuit board 10. This ultimately provides electrical continuity through the system, that is through the assembly of connector 100 and its mating connector via the contact subassembly 102 to the main circuit board 10. The bent portion 160 of each of the surface mount tail ends 136 generally forms a right angle with each mounting surface 162 being positioned and configured to abut or be flush with the mounting face 12 of the main circuit board 10. In an example, each of the mounting surfaces 162 is substantially flat and the mounting face 12 of the main circuit board 10 is substantially flat. In an example, the mounting surfaces 162 of the board termination contacts 124 are soldered to the mounting face 12 of the main circuit board 10 by reflow processing. This eliminates the need to solder components to the main circuit board 10 by more complex technique of wave soldering and eliminates the cost of wave soldering.

For further EMI protection, the shield 106 may be provided which generally covers the housing 102 of the connector 100 while leaving open the interface opening 116 for access to the inner receiving area 110 of the housing 102. The shield 106 can be electrically connected to the main circuit board 10 via one or more outwardly extending tabs 160, as best seen in FIGS. 1 and 2. The tabs 160 extend outwardly at a generally right angle and form a substantially flat bottom surface 162 for engaging the main circuit board 10.

A method of manufacturing a surface mounted electrical connector according to the present disclosure comprising the steps of forming the contact subassembly by locating the front dielectric insert 142 on the internal circuit board 124 and attaching the engagement ends 132 of the interface contacts 122 to the supporting surface 140 of the internal circuit board 124 while leaving the free ends 134 of the interface contacts 122 positioned for mating with a mating connector, as shown in FIG. 1. The rear dielectric insert 144 can also be located on the internal circuit board 124 and the engagement ends 134 of the board termination contacts 124 attached to the supporting surface 140 of the internal circuit board 124. The engagement ends 132 and 134 can be attached to the internal circuit board 124 by soldering, for example. The engagement ends 132 and 134 attach to the capacitive compensation circuits 152 of the internal circuit board 124 to provide electrical continuity through the contact subassembly 102 with capacitive compensation. Both the front dielectric insert 142 and the rear dielectric insert 144 can be positioned and mounted on the internal circuit board 124 by inserting the one or more locating 146 and 148, respectively, thereof into the corresponding locating holes 154 in the internal circuit board 124.

Once the rear dielectric insert 144 and the engagement ends 134 of the board termination contacts 122 are attached to the internal circuit board 124, the surface mount tail ends 136 remain exposed at the rear of the dielectric insert 144, as best seen in FIGS. 3 and 4, and ready for surface mounting to the main circuit board 10.

The bent portions 160 of the surface mount tail ends 136 can then be surface mounted to the main circuit board 10. The bent portions 160 form a generally right angle such that the mounting surfaces 162 of the bent portions 160 are generally parallel to the mounting face 12 of the main circuit board 10. The mounting surfaces 162 of the surface mount tail ends 136 of the contacts 122 can then be surface mounted and attached to the mounting face 12 and electrical circuits of the main circuit board 10 by reflow soldering. The mounting surfaces 162 of the bent portions 160 can be substantially flat for abutting the mounting face 12 of the main circuit board 10. The board termination contacts 122 can be surface mounted to the mounting face 12 of the main circuit board 10 without the need to use wave soldering, thereby saving time and manufacturing costs.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as front, rear, right, left, above, below, upper, lower, top, bottom, linear, elongated, parallel, perpendicular, right angle etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. A surface mount electrical connector, comprising:

a housing defining an inner receiving area, and the housing having opposite first and second ends, the first end having an interface opening for receiving a mating connector;

a contact subassembly received in the inner receiving area of the housing, the contact subassembly including, a plurality of interface contacts, each of the plurality of interface contacts has a free end and an engagement end, and the free ends are configured to mate with corresponding contacts of the mating connector, a plurality of board termination contacts, each of the plurality of board termination contacts has an engagement end and a surface mount tail end, and an internal circuit board having a supporting surface extending from a front end to a rear end, wherein the plurality of interface contacts and the plurality of board termination contacts are mounted to the supporting surface of the internal circuit board with the engagement ends of the plurality of interface contacts and the plurality of board termination contacts being coupled to the internal circuit board, thereby electrically connecting the plurality of interface contacts and the plurality of board termination contacts through the internal circuit board, and wherein each of the surface mount tail ends of the plurality of board termination contacts has a bent portion that defines a mounting surface configured to be surface mounted to a mounting face of a main circuit board, to establish an electrical connection between the plurality of board termination contacts and the main circuit board, wherein the plurality of board termination contacts are supported by a rear dielectric insert that is disposed at the rear end of the internal circuit board, the rear dielectric insert extending from a front portion coupled to each of the engagements ends of the board termination contacts to a rear portion coupled to each of the surface mount tail ends of the board termination contacts, and wherein the mounting surface of each of the surface mount tail ends extends from the bent portion and beyond both the rear portion of the rear dielectric insert and the rear end of the internal circuit board.

2. The surface mount electrical connector of claim 1, wherein the mounting surface of each of the surface mount tails ends of the plurality of termination contacts is configured to abut the mounting face of the main circuit board.

3. The surface mount electrical connector of claim 2, wherein each of the mounting surfaces is substantially flat and the mounting face of the main circuit board is substantially flat.

4. The surface mount electrical connector of claim 2, wherein the mounting surfaces of the plurality of board termination contacts are soldered to the mounting face of the main circuit board.

5. The surface mount electrical connector of claim 2, wherein the internal circuit board has capacitive compensation circuits.

6. The surface mount electrical connector of claim 1, wherein the bent portions of the plurality of board termination contacts generally form a right angle.

7. The surface mount electrical connector of claim 1, wherein the plurality of interface contacts are supported by a front dielectric insert separate from the rear dielectric insert.

8. The surface mount electrical connector of claim 1, wherein each of the front and rear dielectric inserts has a locating post configured for insertion into a corresponding hole of the internal circuit board.

9. The surface mount electrical connector of claim 1, wherein the engagement ends of the plurality of interface contacts and board termination contacts are soldered to the internal circuit board.

10. The surface mount electrical connector of claim 1, further comprising a shield covering the housing, the shield being electrically connected to the main circuit board via a tab extending outwardly from the shield.

11. A high speed electrical connector, comprising:

a housing defining an inner receiving area, and the housing having opposite first and second ends, the first end having an interface opening for receiving a mating connector;

a contact subassembly received in the inner receiving area of the housing, the contact subassembly including, a plurality of interface contacts, each of the plurality of interface contacts has a free end and an engagement end, and the free ends are configured to mate with corresponding contacts of the mating connector, a plurality of board termination contacts, each of the plurality of board termination contacts has an engagement end and a surface mount tail end, and an internal circuit board having a supporting surface, wherein the plurality of interface contacts and the plurality of board termination contacts are mounted to the supporting surface of the internal circuit board with the engagement ends of the plurality of interface contacts and the plurality of board termination contacts being coupled to the internal circuit board, thereby electrically connecting the plurality of interface contacts and the plurality of board termination contacts through the internal circuit board, and the internal circuit board having capacitive compensation circuits, wherein each of the surface mount tail ends of the plurality of termination contacts has a bent portion that defines a mounting surface configured to be surface mounted to a mounting face of a main circuit board, to establish an electrical connection between the plurality of board termination contacts and the main circuit board, wherein the plurality of board termination contacts are supported by a rear dielectric insert that is disposed at the rear end of the internal circuit board, the rear dielectric extending from a front portion coupled to each of the engagements ends of the board termination contacts to a rear portion coupled to each of the surface mount tail ends of the board termination contacts, and wherein mounting surface of each of the surface mount tail ends extends from the bent portion and beyond both the rear portion of the rear dielectric insert and the rear end of the internal circuit board.

12. The high speed electrical connector of claim 11, wherein the bent portions of the plurality of board termination contacts generally form a right angle such that the mounting surfaces are positioned to be surface mounted to the mounting face of the main circuit board by soldering.

13. The high speed electrical connector of claim 12, wherein each mounting surface is substantially flat.

14. The high speed electrical connector of claim 12, wherein the engagement ends of the plurality of interface contacts and board termination contacts are soldered to the internal circuit board.

15. A method of manufacturing a surface mounted electrical connector, comprising the steps of:

forming a contact subassembly by, attaching engagement ends of a plurality of interface contacts to a supporting surface of an internal circuit board leaving free ends of the plurality of interface contacts positioned for mating with a mating connector;

coupling a plurality of board termination contacts to a rear dielectric insert, each of the board termination contacts including an engagement end and a bent portion defining a mounting surface that extends from the bent portion and beyond the rear portion of the rear dielectric insert; and disposing the rear dielectric insert on the rear end of the internal circuit board such that the engagement ends of the plurality of board termination contacts are attached to the supporting surface of the internal circuit board and the mounting surface extends beyond rear end of the internal circuit board, wherein the bent portions of the plurality of board termination contacts of the contact subassembly are configured to be surface mounted to a mounting face of a main circuit board by reflow soldering.

16. The method of claim 15, wherein the bent portions of the plurality of board termination contacts are configured to be soldered to the main circuit board without using a wave soldering process.

17. The method of claim 15, wherein the bent portions each have a substantially flat mounting surface for abutting the mounting face of the main circuit board.

18. The method of claim 15, wherein the internal circuit board includes capacitive compensation circuits coupled to the engagement ends of the plurality of interface contacts and the plurality of board termination contacts.

19. The method of claim 18, wherein the engagement ends of the plurality of interface contacts and the plurality of board termination contacts are attached to the internal circuit board by soldering.

20. The method of claim 15, wherein the plurality of interface contacts are supported by a front dielectric insert and the plurality of board termination contacts are supported by the rear dielectric insert separate from the front dielectric insert.

* * * * *